US008333046B2

(12) United States Patent
Hedegaard et al.

(10) Patent No.: US 8,333,046 B2
(45) Date of Patent: Dec. 18, 2012

(54) PLATFORM, IN PARTICULAR INTERIOR PLATFORM FOR TUBULAR TOWER

(75) Inventors: Thomas Hedegaard, Hammel (DK); Claus Engelbrecht, Egå (DK)

(73) Assignee: Intellligent Tower Solutions APS, Arhus V (DK)

( * ) Notice: Subject to any disclaimer, the term of this patent is extended or adjusted under 35 U.S.C. 154(b) by 0 days.

(21) Appl. No.: 13/000,673

(22) PCT Filed: Jun. 22, 2009

(86) PCT No.: PCT/DK2009/050137

§ 371 (c)(1),
(2), (4) Date: Mar. 24, 2011

(87) PCT Pub. No.: WO2009/155927

PCT Pub. Date: Dec. 30, 2009

(65) Prior Publication Data

US 2011/0173915 A1 Jul. 21, 2011

(30) Foreign Application Priority Data

Jun. 23, 2008 (DK) ..... 2008 00860

(51) Int. Cl.
*E04H 12/18* (2006.01)

(52) U.S. Cl. ..... 52/645; 52/82; 52/650.3

(58) Field of Classification Search ..... 52/108, 52/67, 645, 641, 633, 632, 646, 649.5, 82, 52/118, 650.3
See application file for complete search history.

(56) References Cited

U.S. PATENT DOCUMENTS

| | | | | | |
|---|---|---|---|---|---|
| 3,686,818 | A | * | 8/1972 | Bini | 52/646 |
| 4,337,560 | A | * | 7/1982 | Slysh | 29/897.31 |
| 4,521,998 | A | * | 6/1985 | DeLorme | 52/81.3 |
| 4,736,553 | A | * | 4/1988 | Geiger | 52/81.2 |
| 4,761,929 | A | * | 8/1988 | Zeigler | 52/646 |
| 4,866,892 | A | * | 9/1989 | Satoh et al. | 52/108 |
| 5,062,243 | A | * | 11/1991 | Kumagai | 52/66 |
| 6,028,570 | A | * | 2/2000 | Gilger et al. | 343/915 |
| 7,703,257 | B2 | * | 4/2010 | Cueli Lopez | 52/646 |
| 2007/0156536 | A1 | | 7/2007 | Alfandary et al. | |

FOREIGN PATENT DOCUMENTS

| | | | |
|---|---|---|---|
| DE | 280879 A3 | | 9/1987 |
| DE | 280879 A | * | 7/1990 |
| GB | 2 026 980 A | | 2/1980 |
| JP | 09-268757 | | 10/1997 |
| WO | WO 97/28331 | * | 8/1997 |

* cited by examiner

*Primary Examiner* — William Gilbert
(74) *Attorney, Agent, or Firm* — Antonelli, Terry, Stout & Kraus, LLP.

(57) ABSTRACT

A platform (2) in an interior platform for a tubular tower such as a windmill tower (24) made from steel is disclosed—and more specifically, a platform (2) adapted to be assembled in situ from construction element members in order to fit the inside wall (22) of the tower (24), comprising a basic, preferably circular, center module (4), radial, telescoping supporting beam members (6), wherein the construction element members are modules (10, 12 and 14) which are independent of the diameter of the platform (2), and two-piece pivotable modules (16) which incline for mounting as a periphery ring next to the inside wall (22) of the tower (24).

9 Claims, 13 Drawing Sheets

PLATFORM, IN PARTICULAR INTERIOR PLATFORM FOR TUBULAR TOWER

BACKGROUND OF THE INVENTION

1. Field of the Invention

The present invention relates to a platform, in particular an interior platform for a tubular tower, by way of example a windmill tower.

2. Description of the Prior Art

High towers such as windmill towers are provided with a number of platforms for servicemen and engineers who work inside the tower during the construction period and in connection with the following service operation and maintenance work.

The platform is used for resting when climbing the ladder to the top of the tower. Windmill towers have several inside platforms which by way of example eight platforms are very often seen.

Additionally the platforms also serve as safety partitions between the different levels inside the tower. These partitions ensure that dropped tools etc only fall a relative short distance—which is widely used especially in the windmill industry.

Platforms of the introductory mentioned type are today made from individual construction element members for each tower in a custom size. The platforms are made from aluminium floor plates that are bent to be self-supporting. Known plates of this type have a width of approximate 500 mm and are bolted together to achieve the desired sizes with each piece of plate being engineered and manufactured into the specific size and need (FIGS. 27 and 28).

In other words known methods are expensive because of the required engineering and manufacturing costs. At the same time there are often problems delivering the aluminium floor plates needed for the manufacturing. Also the logistics are a problem, because the aluminium floor plates are only produced in a few locations in the world. Furthermore the engineering is done only in a few locations. The relatively long manufacturing and delivery time often causes expensive delay of the construction work on the windmill.

SUMMARY OF THE INVENTION

The invention provides an improved platform of the type discussed above which solves or reduces the need for individual engineering in connection with the assembling of platforms with varying diameters for use as partitions for example inside high windmill towers.

The platform according to the invention comprises a basic center module, radial telescoping supporting beam members, and wherein the construction element members are modules which are independent of the diameter of the platform.

By simple provisions a new platform is achieved which solves or reduces the need for individual engineering in connection with the assembling of platforms with varying diameters for use as partitions such as, for example, inside high windmill towers.

Appropriately, the platform according to the invention may be provided with inner end parts comprising the radial, telescoping supporting beam members rigidly connected with the basic center module.

Furthermore the platform according to the invention may be provided with outer end parts of the radial telescoping supporting beam members which are adapted for connection to the inside wall of the tower by mounting members which, by way of example, comprise magnets.

Preferably the platform according to the invention is manufactured so that the circular center module, the construction element members and at least inner parts of the radial telescoping supporting beam members are injection molded plastic molding material reinforced by suitable strength giving additives such as carbon or glass fibers.

In order to simplify the production and the stocking of construction element members, the platform according to the invention may include construction element members with at least two types of modules to cover the span between center module and inside wall of the tower and two-piece modules which incline to be mounted as a periphery ring next to the inside of the tower wall.

In order to make it possible, adaption of the platform according to the invention to inside tower diameters within a diameter range, each of the two-piece modules comprises a fixed part, which is mounted toward the center of the platform, and a hinged part which pivots to incline from the horizontal position to an inclined position to fit varying diameters of the platform.

Alternatively, the platform according to the invention of one of the modules includes the fixed part having a connection part.

In order to minimize the number of different module sizes, the platform according to the invention may furthermore include at least two types of modules such that a difference between the modules is the angle between the straight sides of the modules and their width, and the modules are assembled by snap-in or spring locks.

In order to simplify a possible reinforcement of the platform according to the invention it may be advantageous that reinforcing steel bands or plates are fit or placed in between the radial supporting beam members and between end parts of interconnected arched modules.

DESCRIPTION OF THE DRAWINGS

In the following the invention is described in more detail with reference to the drawing, in which.

DETAILED DESCRIPTION OF THE INVENTION

FIGS. 1-4 show a preferred embodiment of a platform 2 according to the invention for in situ mounting inside a windmill tower.

Figure 8:
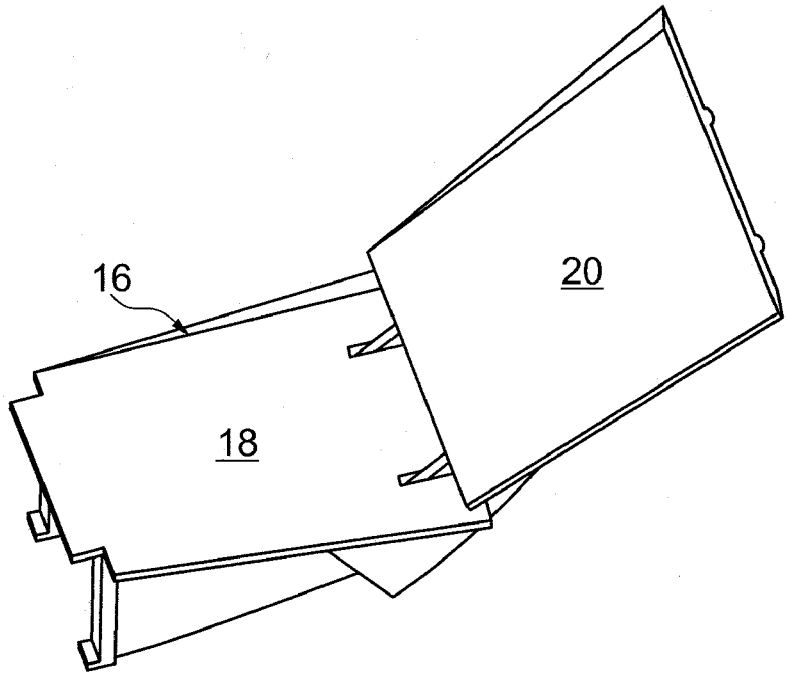
FIG. 8 shows a perspective view of an embodiment for an outer, two-piece construction element member which inclines according to the invention to accommodate interior sections of towers of different diameter.
Figure 9:
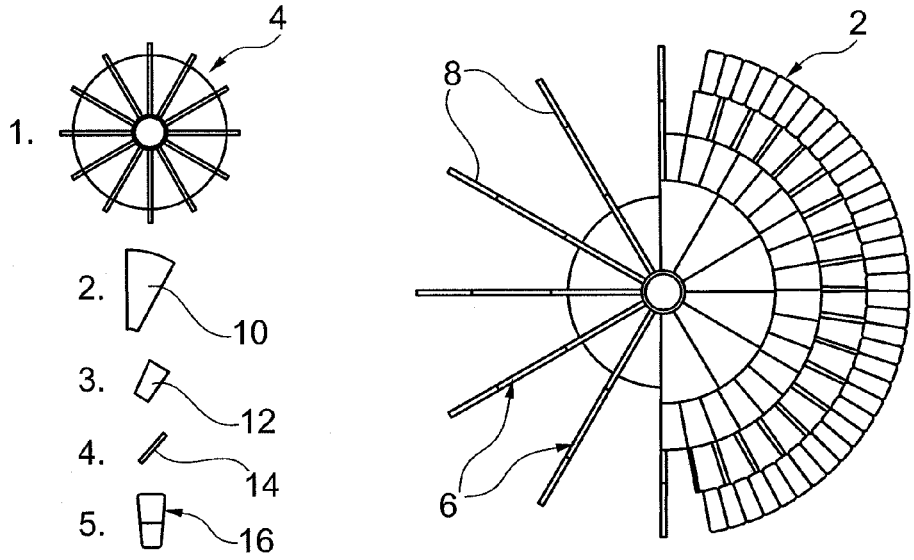
FIG. 9 shows a plane view illustration of different construction element members needed for the construction a platform according to the invention.
Figure 10:
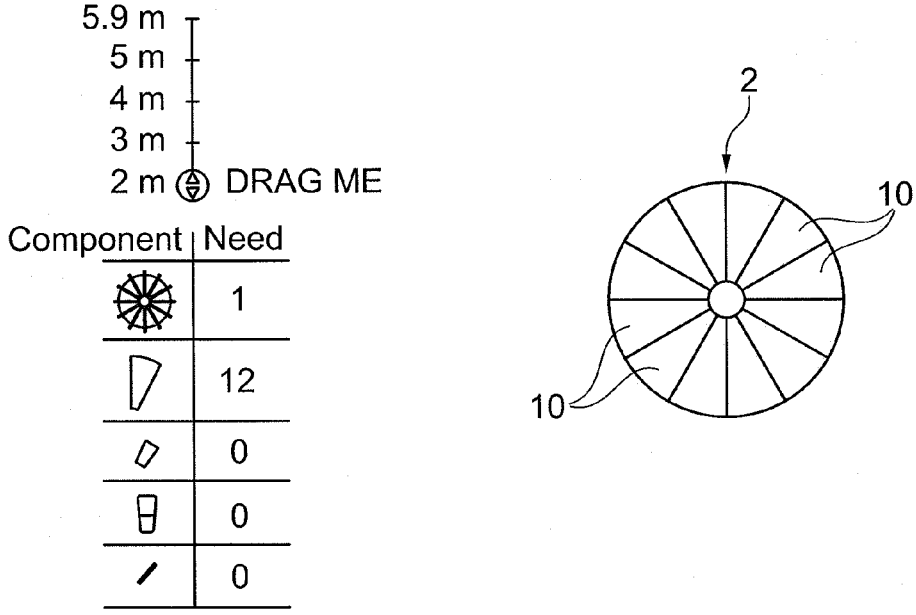
FIG. 10 shows a plane view illustrating different construction element members needed for the construction of a platform with a diameter of 2000 mm according the invention.
Figure 11:
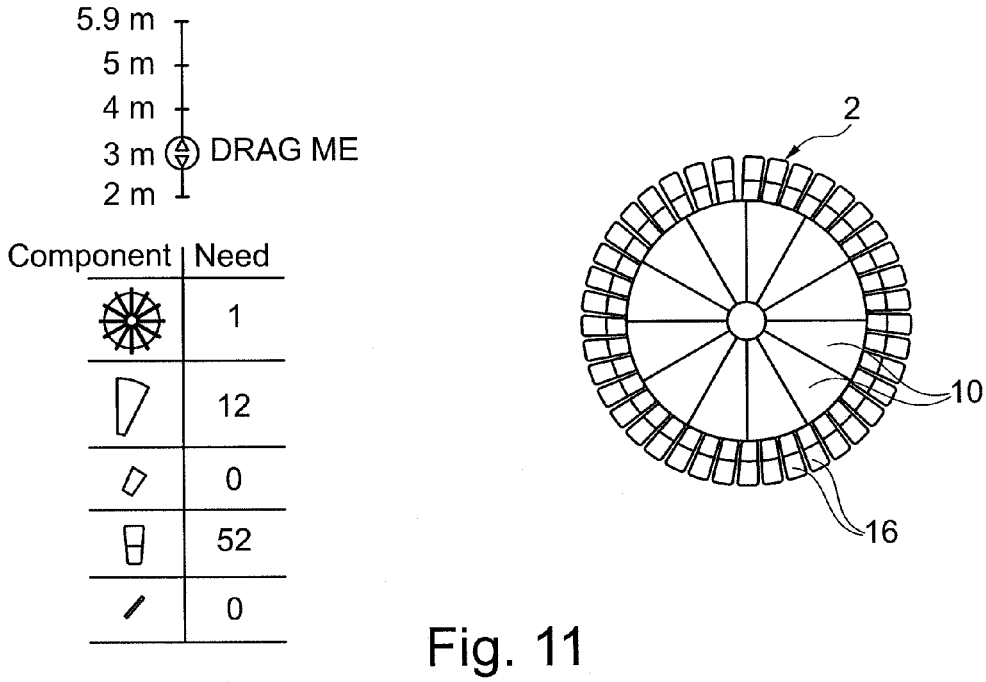
FIG. 11 shows a plane view illustrating the different construction element members needed for the construction of a platform with a diameter of 3000 mm according the invention.
Figure 12:
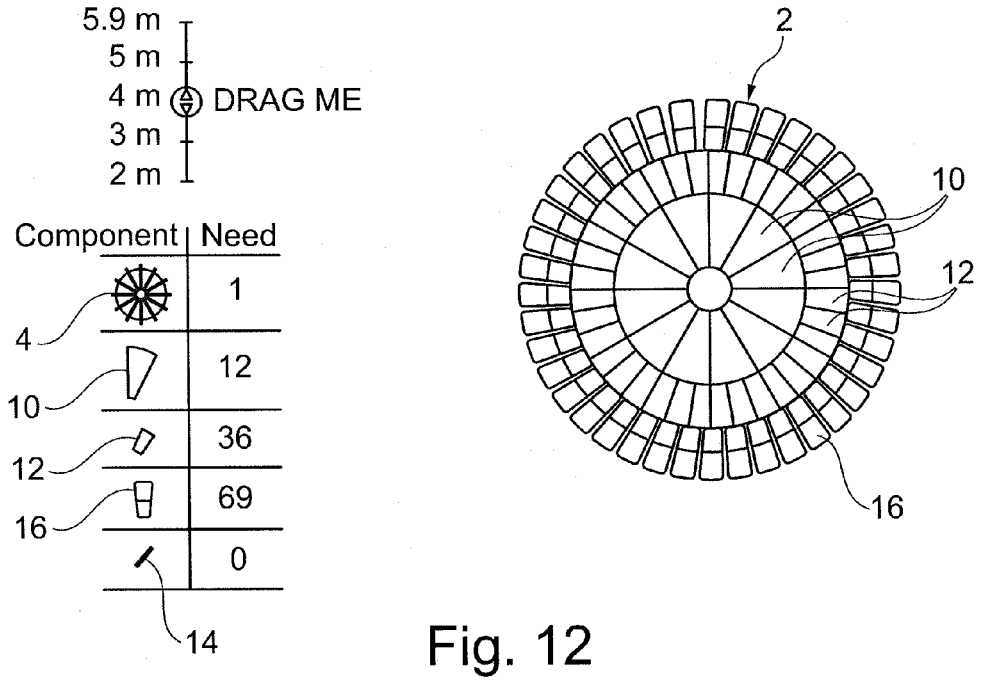
FIG. 12 shows a plane view illustrating the different construction element members needed for the construction of a platform with a diameter of 4000 mm according the invention.
Figure 13:
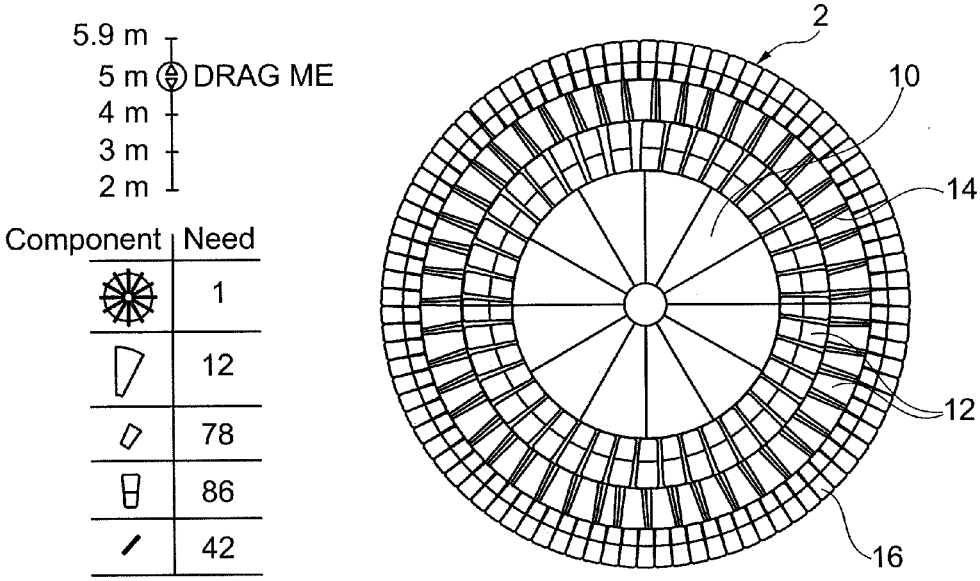
FIG. 13 shows a plane view illustrating the different construction element members needed for the construction of a platform with a diameter of 5000 mm according the invention.

FIG. 9 illustrates a view from the managing system where the placement of the cursor on the construction element members shown in the left hand side of FIG. 9 automatically highlights the following construction element members shown in the right hand side of FIG. 9:

A basic center module 4 comprises twelve radial, telescoping supporting beam members 6. The outer end part 8 thereof includes tubes which by way of example are metal and have a rectangular cross section, twelve inner modules 10, two rows of further intermediate modules 12, where the second row also comprises narrow adapting modules 14, and finally a outermost row of two-piece modules 16 (FIG. 8) comprising a fixed part 18, which is mounted toward the center of the platform 2, and a hinged part 20 which pivots from the horizontal position to an inclined position to fit varying diameters of the platform 2.

Figure 1:
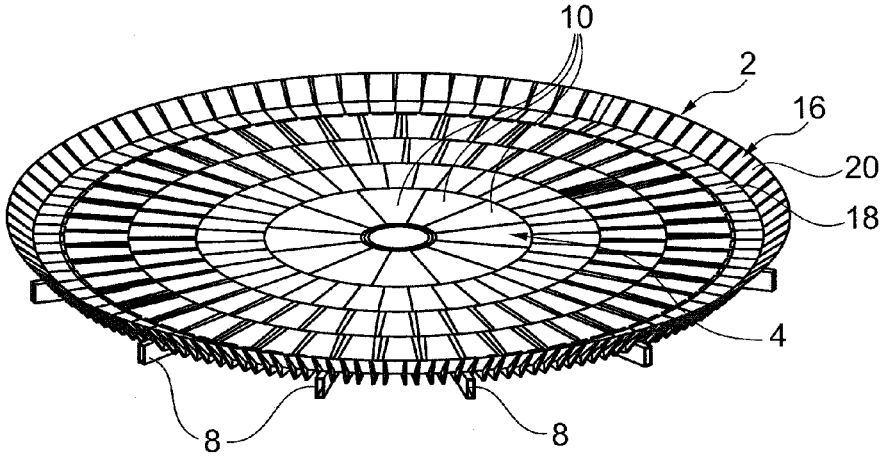
FIG. 1 shows a perspective view of an embodiment of a platform construction according to the invention.
Figure 2:
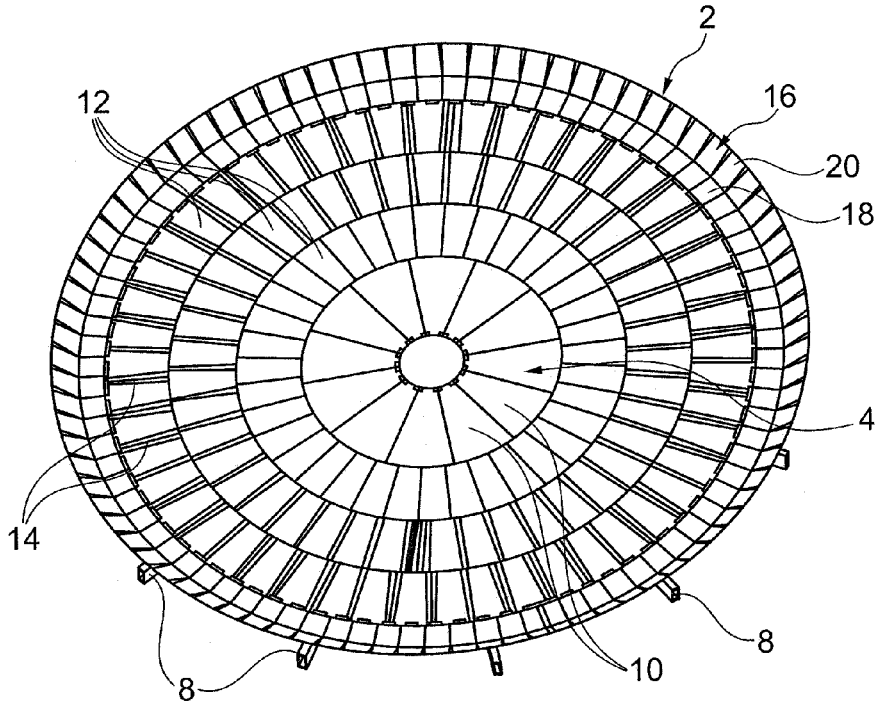
FIG. 2 shows a perspective top view of the platform of FIG. 1.
Figure 3:
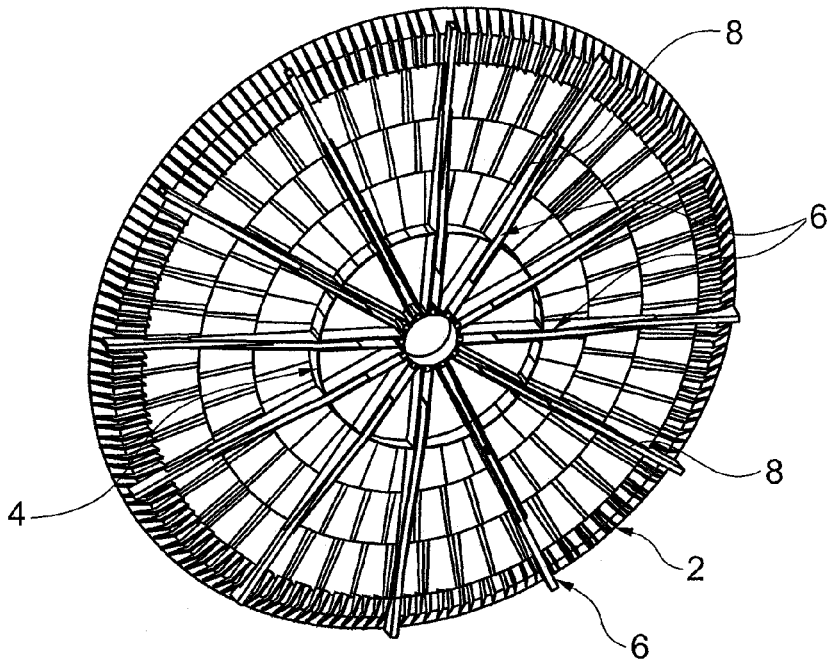
FIG. 3 shows a perspective view of the platform of FIG. 2 which is seen from the lower side thereof.
Figure 4:
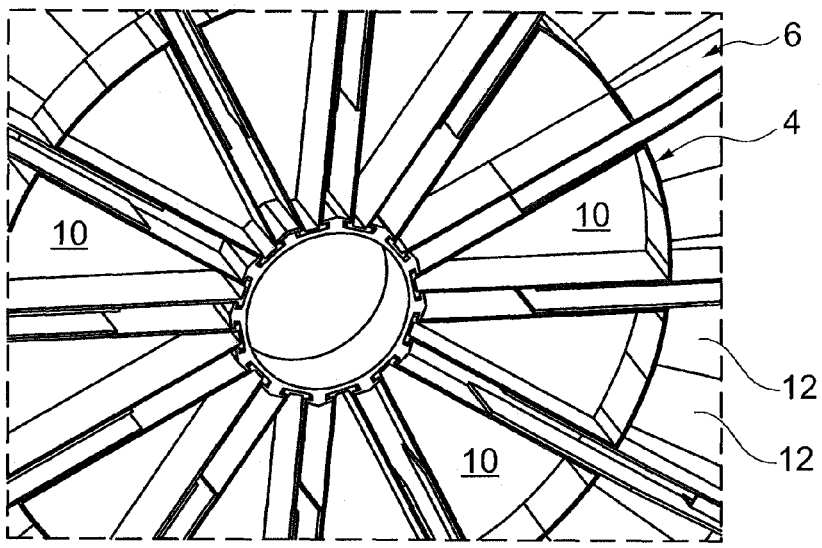
FIG. 4 shows a perspective enlarged partial view of the platform of FIG. 3.
Figure 5:
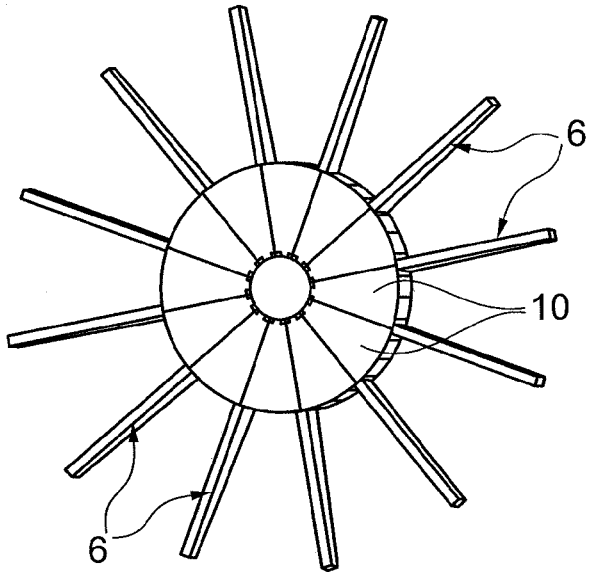
FIG. 5 shows a perspective view of an embodiment of a center construction element member with radial supporting beam members for a platform according to the invention.
Figure 6:
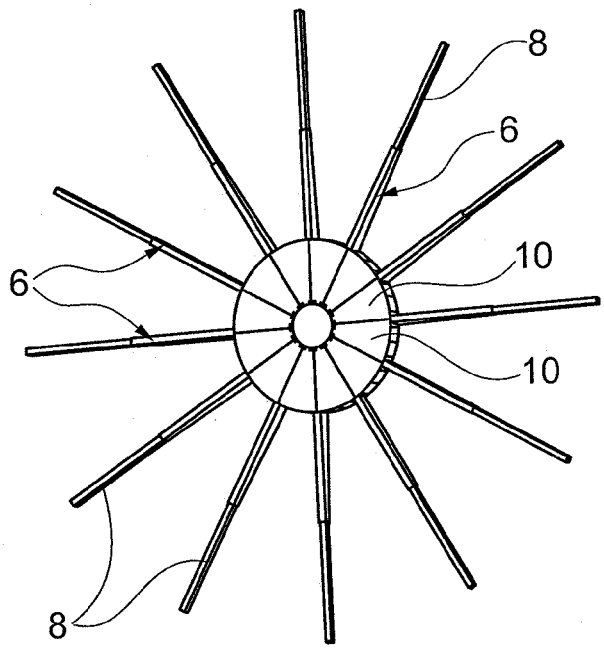
FIG. 6 shows a perspective view of the center construction element member of FIG. 3 with telescoping extended radial supporting beam members.
Figure 7:
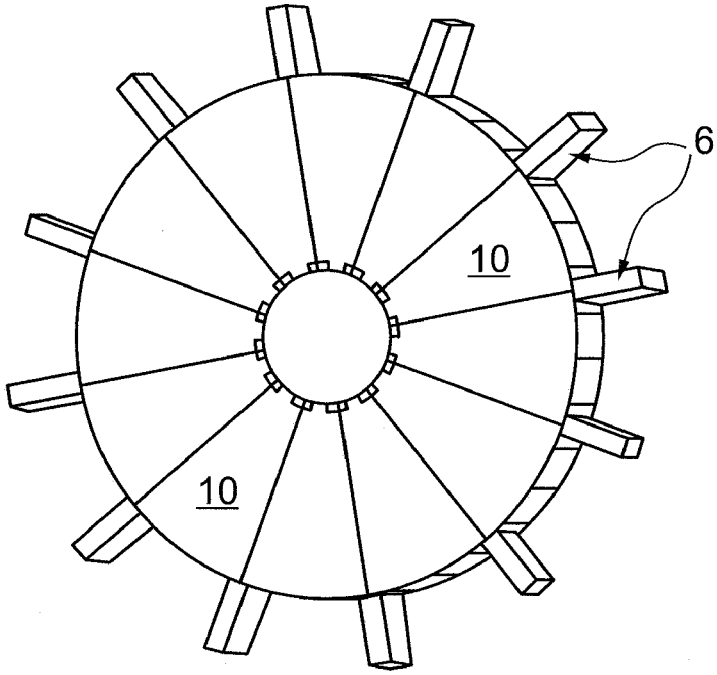
FIG. 7 shows an enlarged perspective view of the center construction element member with shortened radial supporting beam members.

A platform for mounting inside the tower near the top thereof may have a basic module 4 and only twelve inner modules 10. The outer end surfaces of the modules 10 may be directly connected to the inside wall 22 of the tower 24 possibly by suitable mountings. In other words, the top platform does not require the radial, telescoping supporting beam members 6. FIGS. 5-7 show the center module 4 comprising twelve radial supporting beam members 6. FIG. 6 furthermore shows the outer end parts 8 of the radial, telescoping supporting beam members 6. The twelve inner modules 10 are shown in FIGS. 5-7.

FIGS. 10-14 illustrate a system using an interactive computer program for managing the different construction element members in the form of the basic center module 4, arched modules 10, 12 and 14 and possibly two-piece modules 16 required for the assembling of a platform according to the invention by varying the diameter of the platform 2 from 2000 mm to 5900 mm as indicated in the upper left corner of FIGS. 10-14.

Figure 14:
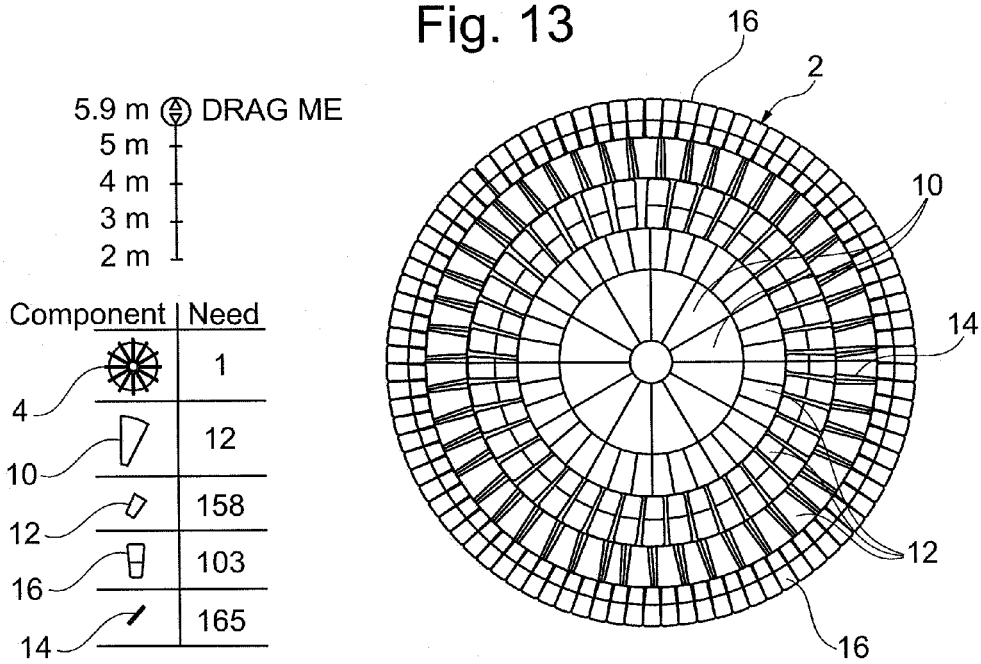
FIG. 14 shows a plane view illustrating the different construction element members needed for the construction of a platform with a diameter of 5900 mm according the invention.
Figure 15:
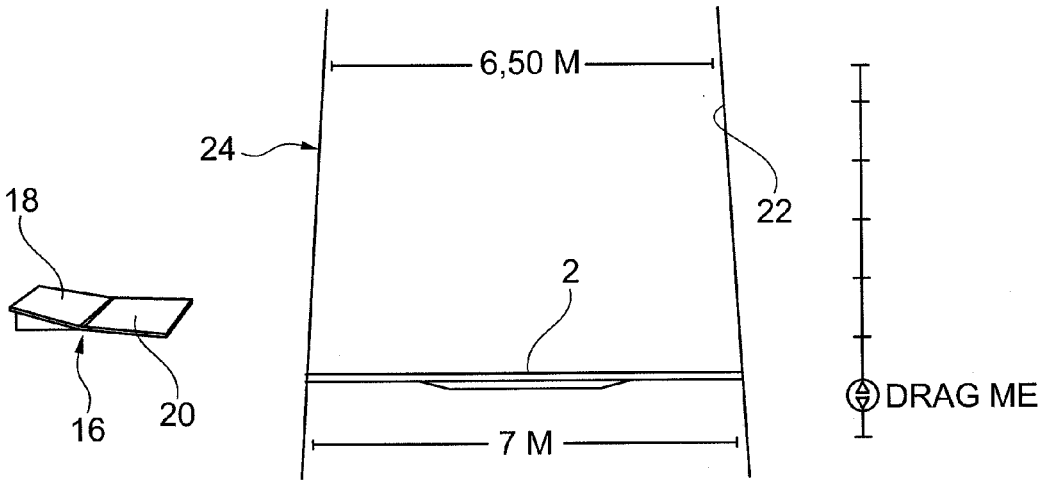
FIG. 15 shows a combined plane and perspective view illustrating the proper angular position of the outer two-piece construction element member of a platform which inclines according to the invention with a diameter of about 7000 mm.
Figure 16:
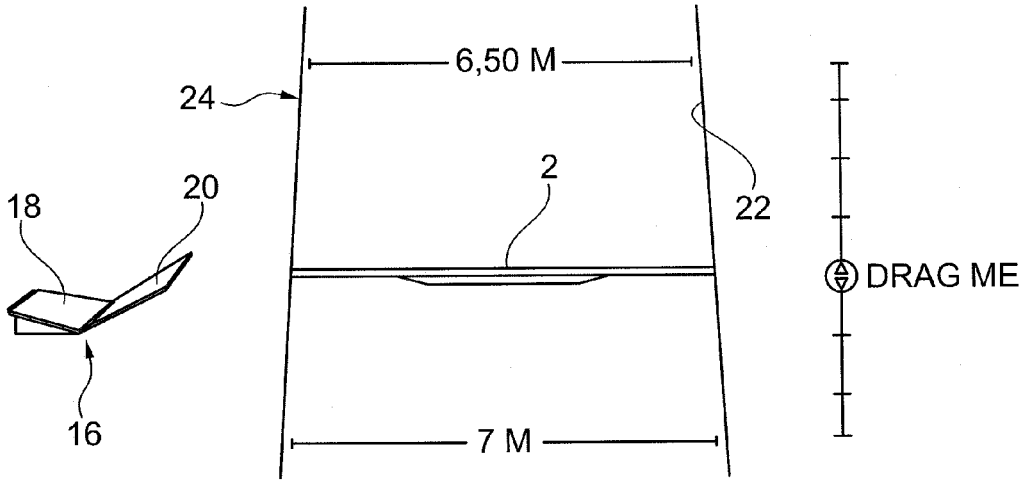
FIG. 16 shows a combined plane and perspective view illustrating the proper angular position of the outer, two-piece construction element member which inclines of a platform according to the invention with a diameter between 6500-7000 mm.
Figure 17:
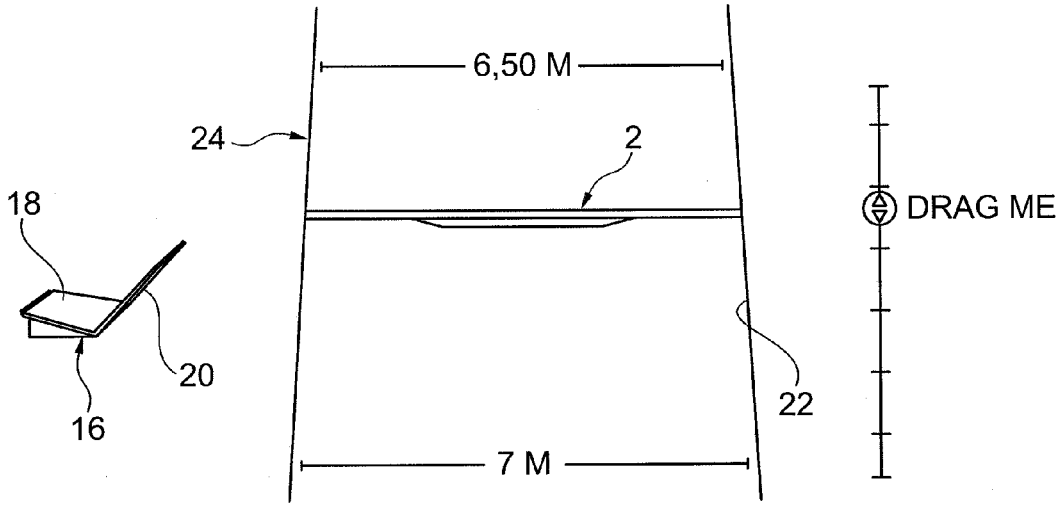
FIG. 17 shows a combined plane and perspective view illustrating the proper angular position of the outer two-piece construction element member of a platform which inclines according to the invention with a diameter between 6500-7000 mm.
Figure 18:
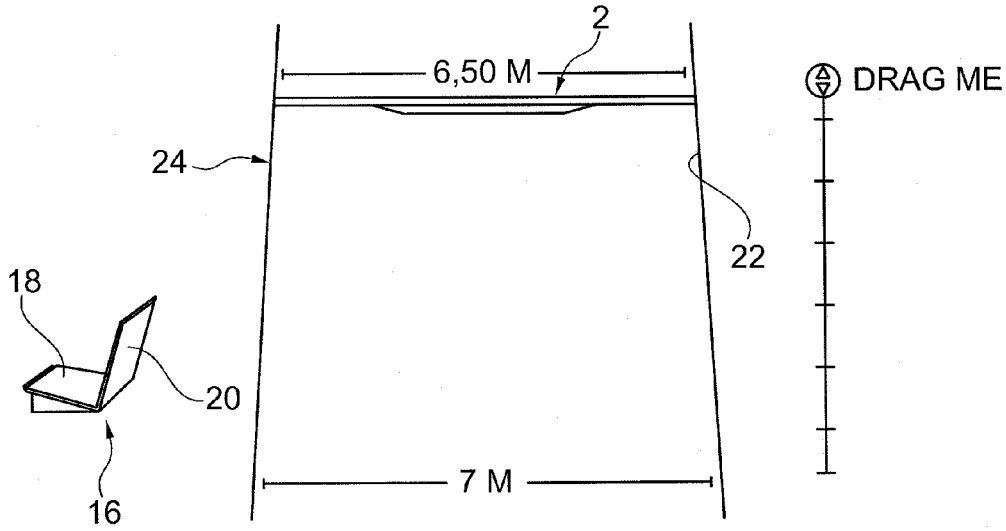
FIG. 18 shows a combined plane and perspective view illustrating the proper angular position of the outer two-piece construction element member of a platform which inclines according to the invention with a diameter close to 6500 mm.
Figure 19:
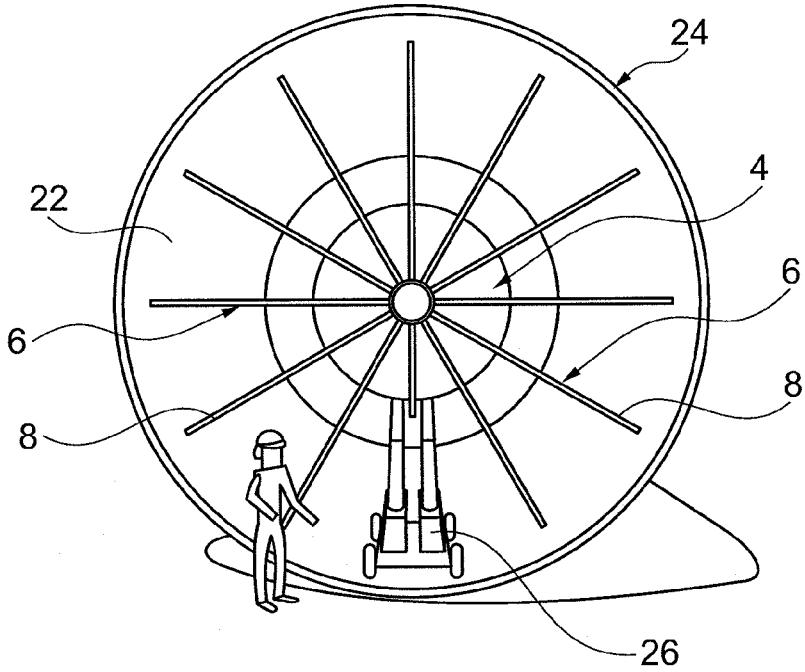
FIG. 19 show a perspective view illustrating the placement of the basic center construction element member with telescoping extended radial supporting beam members of FIG. 3 inside a horizontal windmill tower section.

By way of example, FIG. 14 illustrates the following total number of different construction element members required for assembling of a platform 2 having a diameter of 5900 mm:

Basic centre module 4: 1
Radial telescoping supporting beam members 6: 12
Inner modules 10: 12
Intermediate modules 12: 158
Two-piece outer hinged modules 16: 103
Narrow adapting modules 14: 165

FIGS. 15-18 illustrate the dynamic pivoting of the hinged part 20 of the two-piece module 16 from a horizontal position to a specific inclined position in relation to the inside wall 22 of the tower 24 by varying the diameter of the platform 2.

In the left hand side of FIGS. 15-18, the actual inclined position of the hinged part 20 is shown in perspective views, while the actual height position of the platform 2 inside the tower 24 is indicated on the scale in the right hand side thereof.

Figure 20:
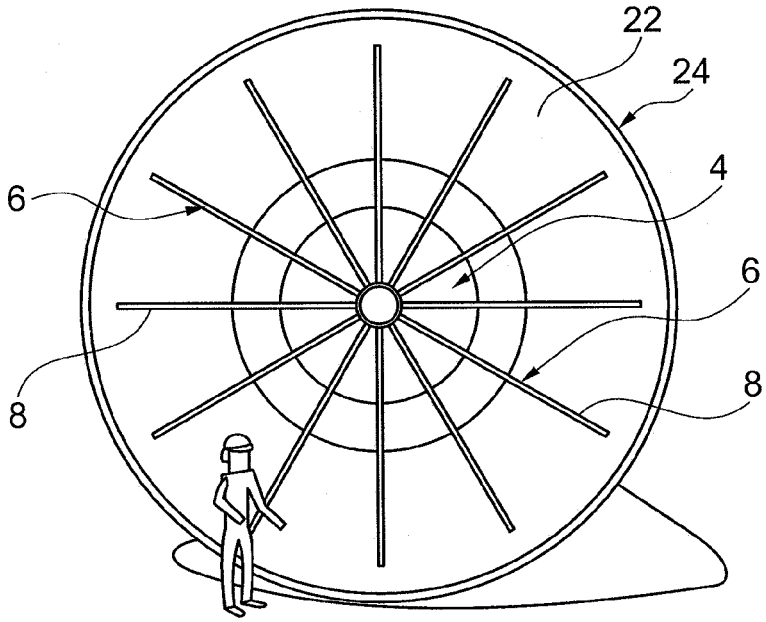
FIG. 20 shows a perspective view illustrating the mounting of the basic center construction element member of FIG. 17 according to the invention.

FIGS. 19-24 illustrate the mounting and the assembling of the platform 2 inside a horizontal part of a windmill tower 24. The basic center module 4, including twelve radial, telescoping supporting beam members 6, which are not in an extending position, is transported inside the tower 24 on a special vehicle 26. In the correct position, the basic center module 4 is raised into a vertical position centrally in the tower 24, before the radial, telescoping supporting beam members 6 are radially extended and the outer parts 8 thereof are connected rigidly to the inside wall 22 of the tower (FIG. 20).

Figure 21:
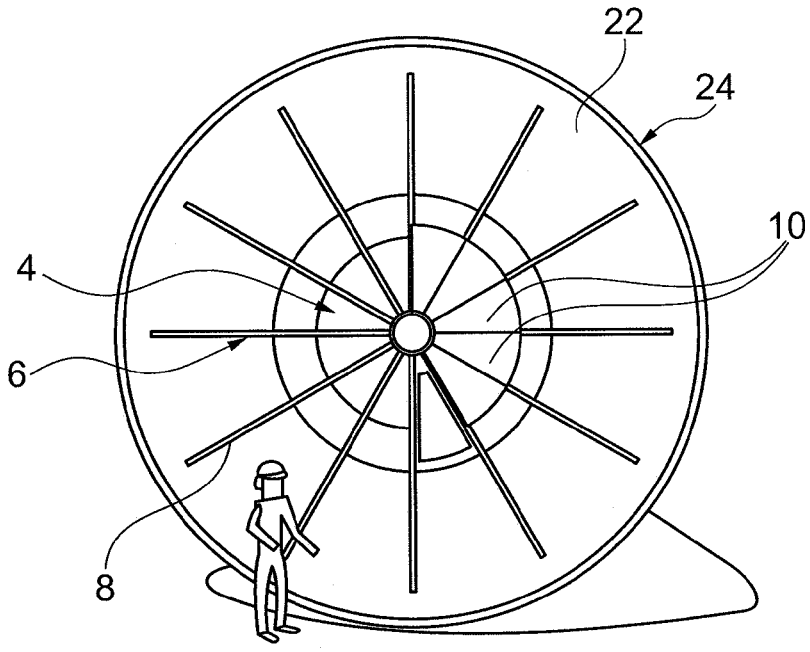
FIG. 21 shows a perspective view illustrating the mounting of an innermost ring of construction element members between the radial supporting beam members of a platform according to the invention.

Then the twelve inner modules 10, if not already mounted, are mounted by snap-in or spring locks, as indicated in FIG. 21. Then, following the mounting of first ring-shaped row of intermediate arched modules 12, as indicated in FIG. 22, the mounting of next ring-shaped row of both intermediate modules 12 mixed with narrow adapting modules 14, as indicated in FIG. 23, and finally the mounting of the outermost ring-shaped row of two-piece pivoting modules 16, as indicated in FIG. 24 occurs.

Regardless the size of the tower 24, all platforms 2 have a basic center module 4 and twelve inner modules 10 around the basic center module 4. The modules 10, 12 and 14 are provided with a gap/groove between the modules 12 and 14 which serves as guiding channels for the radial, telescoping supporting beam member 6, which are elongated from the basic center module 4 to the inside wall 22 of the tower 24.

The platforms 2 comprise a central, circular removable cover. However, some of the uppermost platforms 2 may often be without such central covers because often the uppermost platforms may require a central passage for possible twisting electrical cables, which from there and down through the tower are mounted on the inside wall by special cable clamps.

Figure 22:
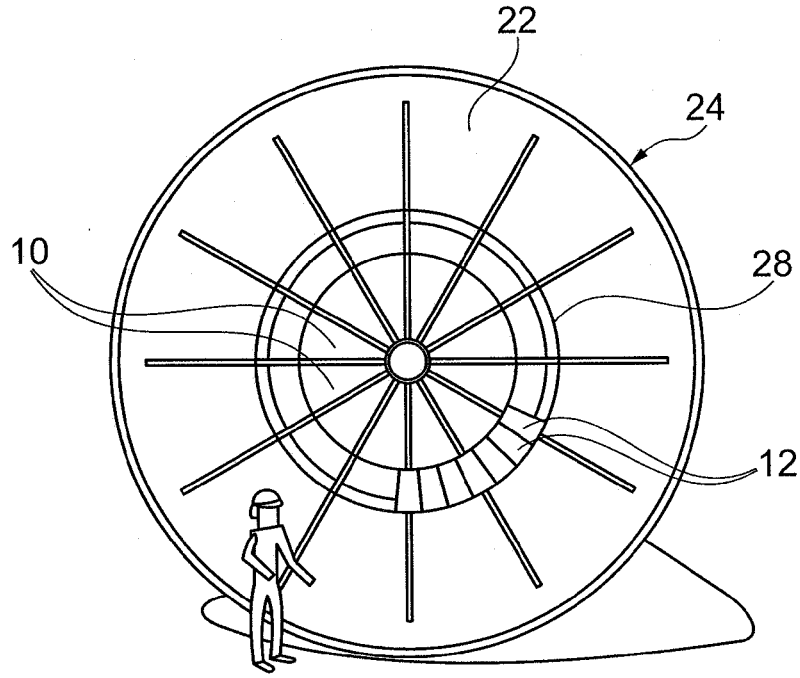
FIG. 22 shows a perspective view illustrating the mounting of the next ring of construction element members between the radial supporting beam members of a platform according to the invention.
Figure 23:
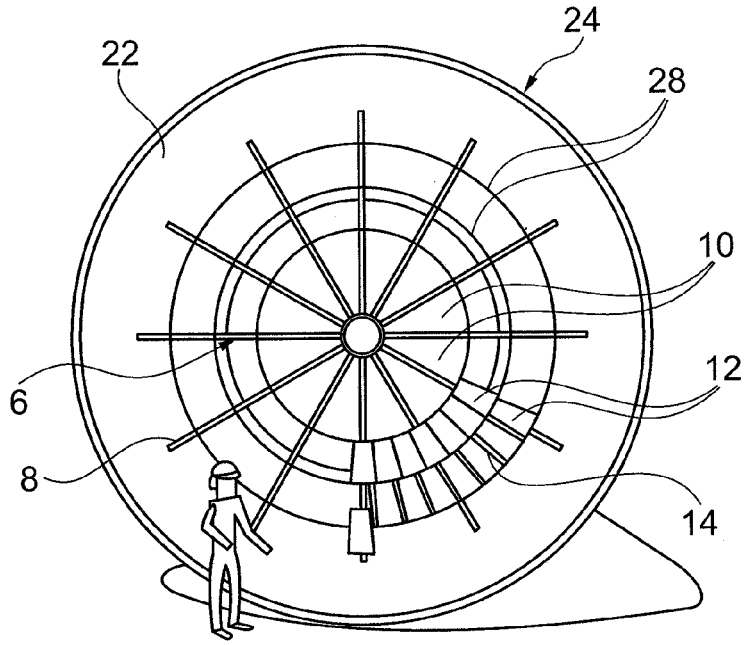
FIG. 23 shows a perspective view illustrating the mounting of the next ring of construction members between the radial supporting beam members of a platform according to the invention.
Figure 24:
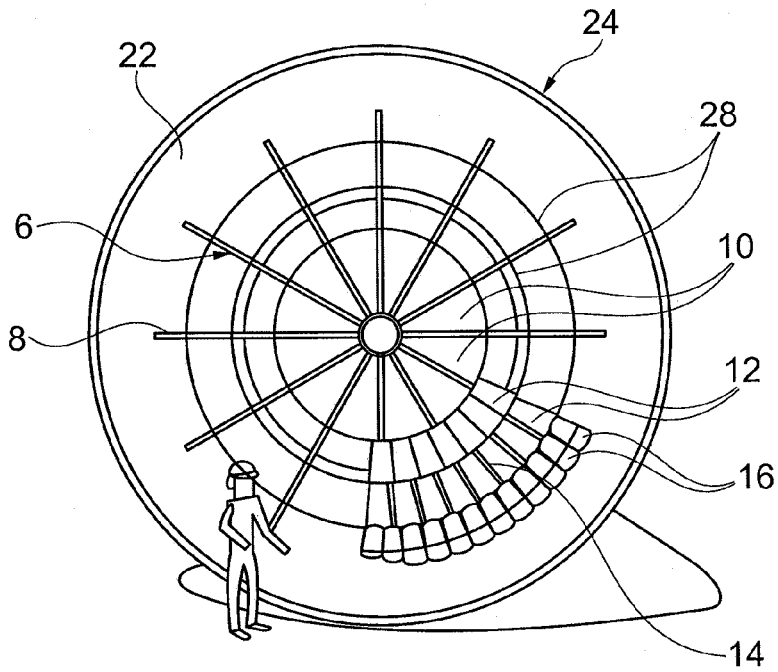
FIG. 24 shows a perspective view illustrating the mounting of the outermost ring of two-piece construction members of a platform which incline according to the invention.
Figure 26:
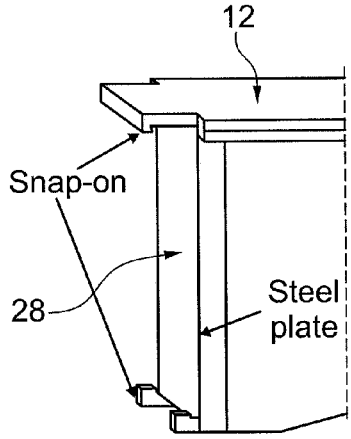
FIG. 26 shows a perspective view illustrating how steel which inclines is positioned in between the ring-shaped rows of arched construction element members in order to reinforce the platform according the invention.

As furthermore indicated in FIGS. 22-24, reinforcing arched bands or plates 28 made from steel are fit in between the radial supporting beam members 6 and between end parts of interconnected modules 12, 14 and 16 (FIG. 26).

In order to ensure the necessary carrying ability in the span between the radial, telescopic supporting beam members 6, all of the modules 10, 12 and 14 are snapped together around vertical steel bands or plates 28, which run from supporting beam member 6 to supporting beam member 6, where the rings of modules 10, 12 and 14 meet.

The steel bands or plates 28 provide strength in the vertical direction and the plastic modules 10, 12 and 14 which are snapped on around the steel bands or plates 28, support the steel bands or plates 28 from collapsing. In this manner an improved strength and stiffness of the platform 2, which uses very little steel, is obtained. The steel bands or plates 28 are only mounted where improved strength or stiffness is needed.

Figure 25:
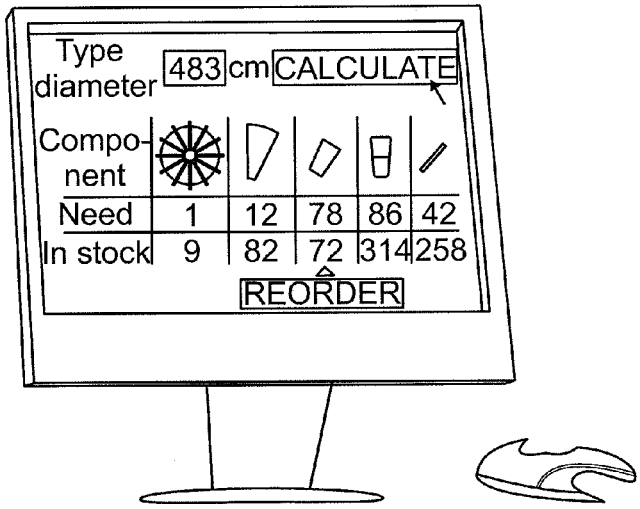
FIG. 25 shows on computer screen how the calculation takes place for determination of the required number of different constructions element members for a platform having a diameter of 483 mm in the upper line of the screen.

FIG. 25 illustrates the monitoring and the controlling the stock of the necessary construction element members for assembling a platform of a specific size by varying the diameter thereof.

The computer screen of FIG. 25 shows the specific numbers of the modules required for assembling of a platform having a diameter of 483 cm, which are indicated in the "need" line of the screen. One basic center module 4, includes twelve radial, telescoping supporting beam members 6, twelve arched modules 10, 78 intermediate modules 12, 86 two-piece pivoting modules 16 and 42 adapting modules 14.

Figure 27:
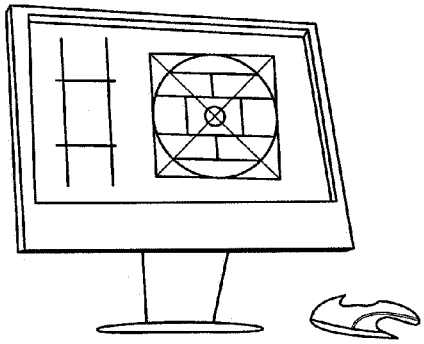
FIG. 27 shows on a computer screen how the prior art platform construction takes place by creating individually shaped plate items of aluminium floor plate.
Figure 28:
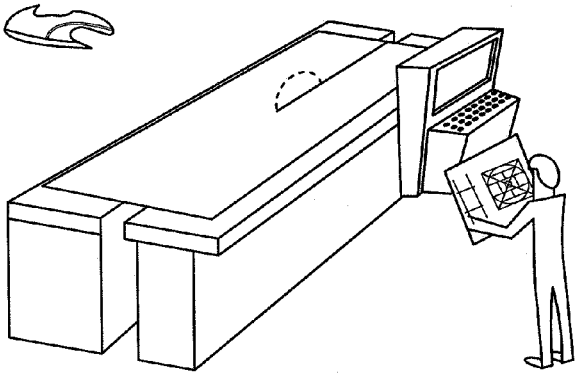
FIG. 28 shows a perspective view illustrating the prior art of cutting up of the individually shaped aluminium floor plates for a specific windmill platform.

FIGS. 27 and 28 illustrate the prior art situation, where the construction of platforms of the actual type of platforms currently are in use made from individually engineered and manufactured construction element members for each tower in a custom size. The platforms are made from aluminium floor plates that are bent to be self-supporting.

The concept, design and manufacturing of the platform according to the present invention solves or reduces the following issues:

Design time and costs because the platform is modular and there is no need for engineering.

Customer friendly regarding development, costs and mounting because there are only a few modules and these may form all variants of platforms from 2000 mm to at least 8000 mm in diameter, and the system has standard solutions for all needed variants.

Documentation of only standard modules, that only requires a list with a total number of modules.

Manufacturing is made from standard modules which by way of example may be made from plastics that can be manufactured in large quantities at any location of the world.

Mounting of the modules is by way of example made from plastic wherein the modules which are snapped together. There is a minimum of assembling with screws, bolts etc.

Handling is reduced by manufacturing in large quantities and transportation thereof in large containers. At the same time the weight is minimal, which reduces the handling when mounted by way of example in a windmill tower.

Logistics are improved by the use of standard modules which are manufactured by way of example from plastic that may be produced anywhere in the entire world.

In order to adjust the platform in accordance with special customer requirements, it may be possible to substitute a number of arched modules and even parts of said radial, telescopic supporting beam members with a frame and a possible manhole cover. Such a frame may preferably be adapted so that it may be connected to the platform by snap-in or spring locks eliminating the use of screws, bolts and the like.

Alternatively, openings of any form may even be made by cutting in the platform and be provided with a similar shaped frame in order to stiffen the platform area around such an opening.

The invention claimed is:

1. An interior platform for assembly in situ inside of a tubular tower to engage an inside wall of the tubular tower comprising:

a center module attached to radially extending and telescoping supporting beam members of variable length, modules joined to the telescoping supporting beam members to provide a surface between the telescoping supporting beam members and an inclined surface that contacts the inside wall and does not contact the telescoping supporting beam members and wherein the telescoping supporting beam members are varied in length to fit cross sections of the tubular tower of different diameter and the inclined surface is variable in inclination to contact cross sections of the tubular tower of different diameters.

2. A platform according to claim 1, where inner end parts of the telescoping supporting beam members are rigidly connected to the center module.

3. A platform according to claim 1, wherein outer end parts of the telescoping supporting beam members are connectable to the inside wall of the tubular tower by mounting members.

4. A platform according to claim 1, wherein the center module and at least inner parts of the telescoping supporting beam members comprise molded material reinforced by strength enhancing additives including carbon or glass fiber.

5. A platform according to claim 1, comprising at least two types of modules covering a span between the center module and the inside wall of the tubular tower and the at least two types of modules are joined to the telescoping supporting beam members to provide a flat surface and two piece modules which incline to provide the inclined surface and form a peripheral ring proximate to the inside wall of the tubular tower.

6. A platform according to claim 5, where each two piece module which inclines comprises a fixed part, which is mounted toward the central module of the platform, and a hinged part which may be pivoted from a horizontal position to provide the inclined surface and to an inclined position to contact the inside wall to fit varying diameters of the platform.

7. A platform according to claim 6, wherein the fixed part comprises a connection part for connection with an outer end part of one of the modules.

8. A platform according to claim 7, wherein the at least two types of modules are disposed at different radial positions relative to the center module, each type respectively having two straight sides extending from a side closest to the center module radially outward to the inside wall with intersections of the sides closest to the center and the straight sides of each of the different types of modules forming a different angle.

9. A platform according to claim 1, comprising reinforcing metal bands or plates fitting between the telescoping supporting beams and end parts of the modules.

* * * * *